US006591605B2

(12) United States Patent
Lewis

(10) Patent No.: US 6,591,605 B2
(45) Date of Patent: Jul. 15, 2003

(54) SYSTEM AND METHOD FOR CONTROLLING THE AIR / FUEL RATIO IN AN INTERNAL COMBUSTION ENGINE

(75) Inventor: Donald James Lewis, Brighton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 09/878,482

(22) Filed: Jun. 11, 2001

(65) Prior Publication Data

US 2002/0184879 A1 Dec. 12, 2002

(51) Int. Cl.[7] ..... F01N 3/00

(52) U.S. Cl. ..... 60/285; 60/274; 60/276; 60/277

(58) Field of Search ..... 60/274, 276, 277, 60/285, 297

(56) References Cited

U.S. PATENT DOCUMENTS

| | | | | |
|---|---|---|---|---|
| 4,809,501 A | | 3/1989 | Kayanuma et al. | |
| 4,887,576 A | | 12/1989 | Inamoto et al. | |
| 5,119,629 A | * | 6/1992 | Kume et al. | 60/274 |
| 5,220,905 A | * | 6/1993 | Lundahl | 123/681 |
| 5,515,826 A | * | 5/1996 | Hamburg et al. | 123/421 |
| 5,715,796 A | * | 2/1998 | Suzuki et al. | 123/492 |
| 5,927,260 A | | 7/1999 | Kishimoto et al. | |
| 5,953,910 A | * | 9/1999 | Sato et al. | 60/277 |
| 6,119,447 A | * | 9/2000 | Eriksson et al. | 60/274 |
| 6,233,922 B1 | * | 5/2001 | Maloney | 60/276 |

FOREIGN PATENT DOCUMENTS

| | | |
|---|---|---|
| GB | 2189626 A A1 | 10/1987 |
| GB | 2346457 A A1 | 8/2000 |

OTHER PUBLICATIONS

Great Britain Search Report for Application No. GB0211461.9.

* cited by examiner

*Primary Examiner*—Thomas Denion
*Assistant Examiner*—Binh Tran
(74) *Attorney, Agent, or Firm*—Julia Voutyras; Allan J. Lippa

(57) ABSTRACT

A method and system are provided for adjusting an amount of fuel provided to an internal combustion engine based on an output signal from an exhaust gas oxygen sensor positioned downstream of an emission control device. The output signal from the exhaust gas oxygen sensor is compared to a set point reference value. The set point reference value is varied as a function of time, preferably according to a set point waveform that oscillates around an average set point. The average set point may either be a pre-determined constant or it may be determined based on at least one engine operating parameter. An electronic engine controller adjusts the amount of fuel provided to the engine based on the result of the comparison between the output signal of the exhaust gas oxygen sensor and the set point reference value.

19 Claims, 3 Drawing Sheets

SYSTEM AND METHOD FOR CONTROLLING THE AIR / FUEL RATIO IN AN INTERNAL COMBUSTION ENGINE

FIELD OF THE INVENTION

The present invention relates generally to a system and method for controlling the air/fuel ratio in an internal combustion engine, and, more particularly, to a system and method for controlling the air/fuel ratio in an internal combustion engine using feedback from at least one exhaust gas oxygen sensor positioned in the exhaust stream from the engine.

BACKGROUND OF THE INVENTION

To minimize undesirable emissions, such as NOx, HC, and $CO_2$, modern automotive vehicles typically include an emission control device coupled to the engine of the vehicle. For example, many vehicles are equipped with a three-way catalytic converter, which includes a catalyst material capable of storing NOx during periods when the engine is operated in a lean state, and releasing and reducing the stored NOx during periods when the engine is operated in a rich state. Other emission control devices may operate in various ways and have various objectives. In any event, most emission control devices are employed in connection with an engine air/fuel ratio control strategy that monitors and adjusts the air/fuel ratio provided to the engine in order to optimize the emission reduction capability of the emission control device.

To that end, it is known to control the engine air/fuel ratio based on feedback from one or more exhaust gas oxygen sensors positioned in the exhaust stream from the engine. For example, it is known to position an exhaust gas oxygen sensor downstream of the emission control device for the purpose of monitoring the oxygen content of the exhaust gas in the tail pipe. The output signal from the exhaust gas oxygen sensor is compared to a set point reference value to calculate an error value. The error value is generally indicative of whether the air/fuel ratio at the point of the exhaust gas oxygen sensor is rich or lean. An electronic engine controller adjusts an amount of fuel provided to the engine cylinders, and thus the air/fuel ratio therein, based at least in part on the error value. The set point reference value can be either a pre-determined constant value, or it can be determined dynamically based on one or more engine operating parameters, such as engine speed and/or load. According to either method, the set point reference value remains constant for a constant engine speed and/or load.

The inventor has recognized that having a constant set point reference value for an extended period of time tends to lead to an oxygen rich or oxygen lean condition in the catalyst, either of which tending to compromise the efficiency of the emission control device. For example, in a three-way catalytic converter, oxygen saturation of the catalyst may generate higher NOx emissions, and oxygen depletion in the catalyst may generate higher HC and $CO_2$ emissions. Whether the set point reference value is a predetermined constant or dynamically-determined based on engine operating parameters, the set point reference value is constant for extended lengths of time during periods of constant engine speed and/or load. Accordingly, the inventor has recognized a need for a new method and system of adjusting the engine air/fuel ratio based on an output signal of an exhaust gas oxygen sensor.

SUMMARY OF THE INVENTION

The present invention relates to a new method and system for controlling the air/fuel ratio in an engine based on the output of an exhaust gas oxygen sensor positioned in the exhaust stream from the engine. In particular, an emission control device is coupled to an internal combustion engine. An exhaust gas oxygen sensor is also positioned in the exhaust stream, preferably downstream of the emission control device. An electronic engine controller compares an output signal from the exhaust gas oxygen sensor to a set point reference value to calculate an error value. The error value is used to adjust the amount of fuel provided to the engine.

To avoid the condition where the set point reference value is constant over an extended period of time, the present invention causes the set point reference value to vary as a function of time. In various preferred embodiments of the invention, the set point reference value is derived from a periodic waveform, such as a sine waveform, a triangle waveform, or a square waveform for example, that oscillates around an average set point. Accordingly, the set point reference value always varies over time, and, even during periods of extended steady state engine operation (i.e., constant engine speed and/or load), the set point reference value is not held constant. As a result, the engine air/fuel ratio is varied during steady state engine operation, causing oxygen and reductants (HC and $CO_2$) to migrate through the catalyst system, thus periodically refreshing the catalyst storage sites and increasing the efficiency of the emission control device.

DETAILED DESCRIPTION OF A PREFERRED EMBODIMENT

Figure 1:
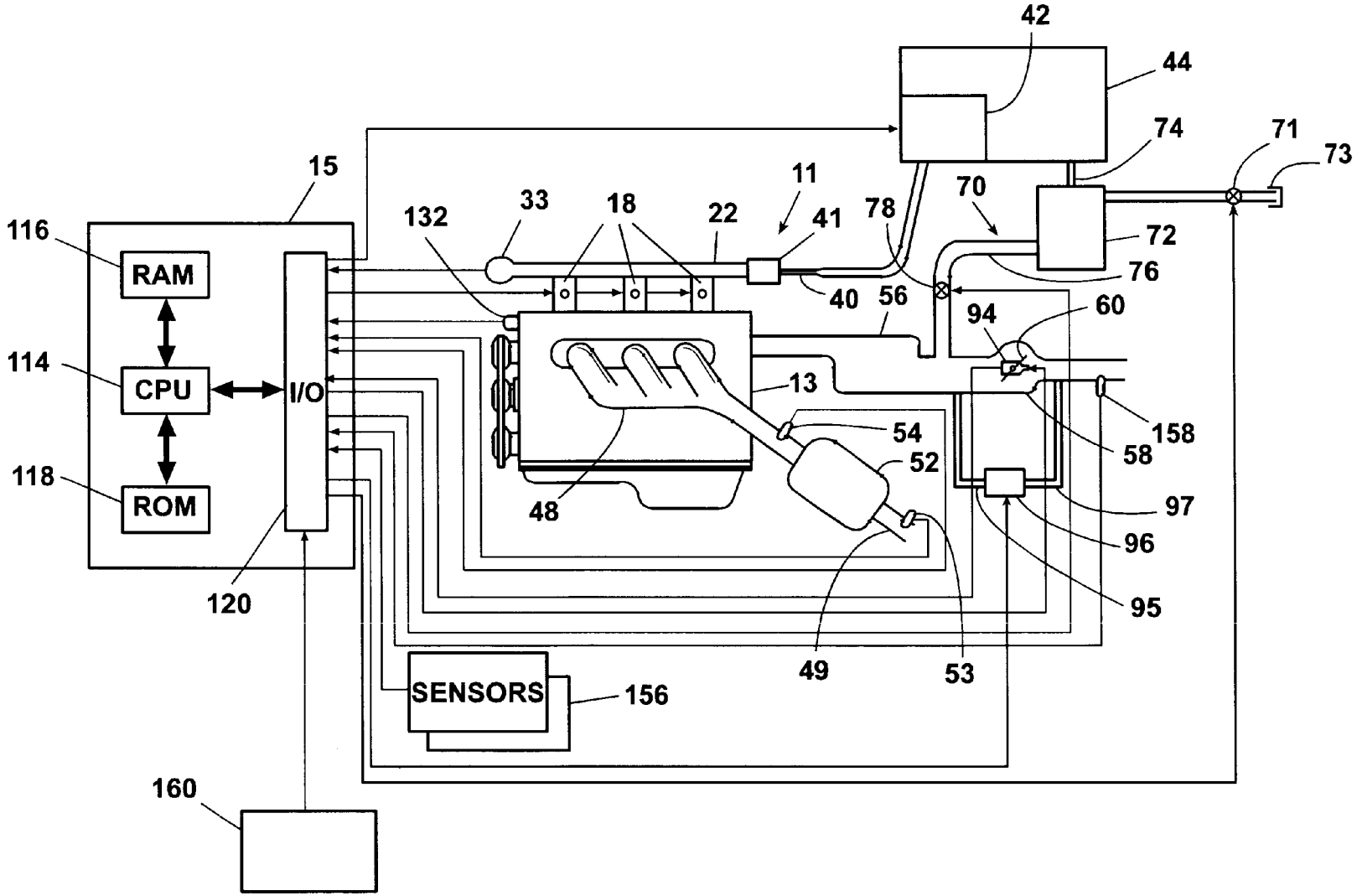
FIG. 1 illustrates an internal combustion engine, according to a preferred embodiment of the invention.

FIG. 1 illustrates an exemplary internal combustion engine according to a preferred embodiment of the invention. Fuel delivery system 11 of a conventional automotive internal combustion engine 13 is controlled by controller 15, such as an EEC or PCM. Engine 13 comprises fuel injectors 18, which are in fluid communication with fuel rail 22 to inject fuel into the cylinders (not shown) of engine 13, and temperature sensor 132 for sensing temperature of engine 13. Fuel delivery system 11 has fuel rail 22, fuel rail pressure sensor 33 connected to fuel rail 22, fuel line 40 coupled to fuel rail 22 via coupling 41, fuel pump 42, which is housed within fuel tank 44, to selectively deliver fuel to fuel rail 22 via fuel line 40.

Controller 15 has CPU 114, random access memory 116 (RAM), computer storage medium 118 (ROM), having a computer readable code encoded therein, which is an electronically programmable chip in this example, and input/output (I/O) bus 120. Controller 15 controls engine 13 by receiving various inputs through I/O bus 120, such as fuel pressure in fuel delivery system 11, as sensed by pressure sensor 33; relative exhaust air/fuel ratio as sensed by exhaust gas sensor 54 and exhaust gas sensor 53; temperature of engine 13 as sensed by temperature sensor 132; measurement of inducted mass airflow (MAF) from mass airflow sensor 158; speed of engine (RPM) from engine speed sensor 160; and various other sensors 156. Controller 15 also creates various outputs through I/O bus 120 to actuate the various components of the engine control system. Such components include fuel injectors 18, fuel delivery system 42, and vapor purge control valve 78.

Fuel pump 42, upon demand from engine 13 and under control of controller 15, pumps fuel from fuel tank 44 through fuel line 40, and into pressure fuel rail 22 for distribution to the fuel injectors 18 during conventional operation. Controller 15 controls fuel injectors 18 to maintain a desired air/fuel (A/F) ratio.

Engine 13 also comprises exhaust manifold 48 coupled to exhaust ports of the engine (not shown). Catalytic converter 52 is coupled to exhaust manifold 48. A first exhaust gas sensor 54 is positioned upstream of catalytic converter 52 in exhaust manifold 48. A second exhaust gas sensor 53 is positioned downstream of catalytic converter 52 in tail pipe 49. Exhaust gas sensors 53 and 54 may comprise any one of a plurality of conventional exhaust gas sensors. For example, sensors 53 and 54 may generate a two-state signal corresponding to engine operation lean or rich of stoichometry. In another embodiment, sensors 53 and 54 provide a signal related to an engine air/fuel ratio in exhaust gases. Those skilled in the art will recognize that other forms of exhaust gas sensors may be used to advantage.

Engine 13 also comprises intake manifold 56 coupled to throttle body 58 having throttle plate 60 therein. Throttle plate 60 is coupled to electric motor 94 so that the position of throttle plate 60 is controlled by controller 15 via electric motor 94. This configuration is commonly referred to as electronic throttle control (ETC), which is also utilized during idle speed control. Idle bypass passageway 97 is coupled between throttle body 58 and intake manifold 56 via solenoid valve 96. Controller 15 provides pulse width modulated signal ISDC to solenoid valve 96 so that air flow is inducted into engine 13 at a rate proportional to the duty cycle of signal ISDC.

Intake manifold 56 is also coupled to vapor recovery system 70. Vapor recovery system 70 comprises charcoal canister 72 coupled to fuel tank 44 via fuel tank connection line 74. Vapor recovery system 70 also comprises vapor purge control valve 78 positioned in intake vapor line 76 between intake manifold 56 and charcoal canister 72, which is controlled by electronic signals from controller 15. Ambient air inlet vent 73 is connected to charcoal canister 72 and air passing therethrough is controlled by inlet valve 71 in response to control signals from controller 15.

Figure 2:
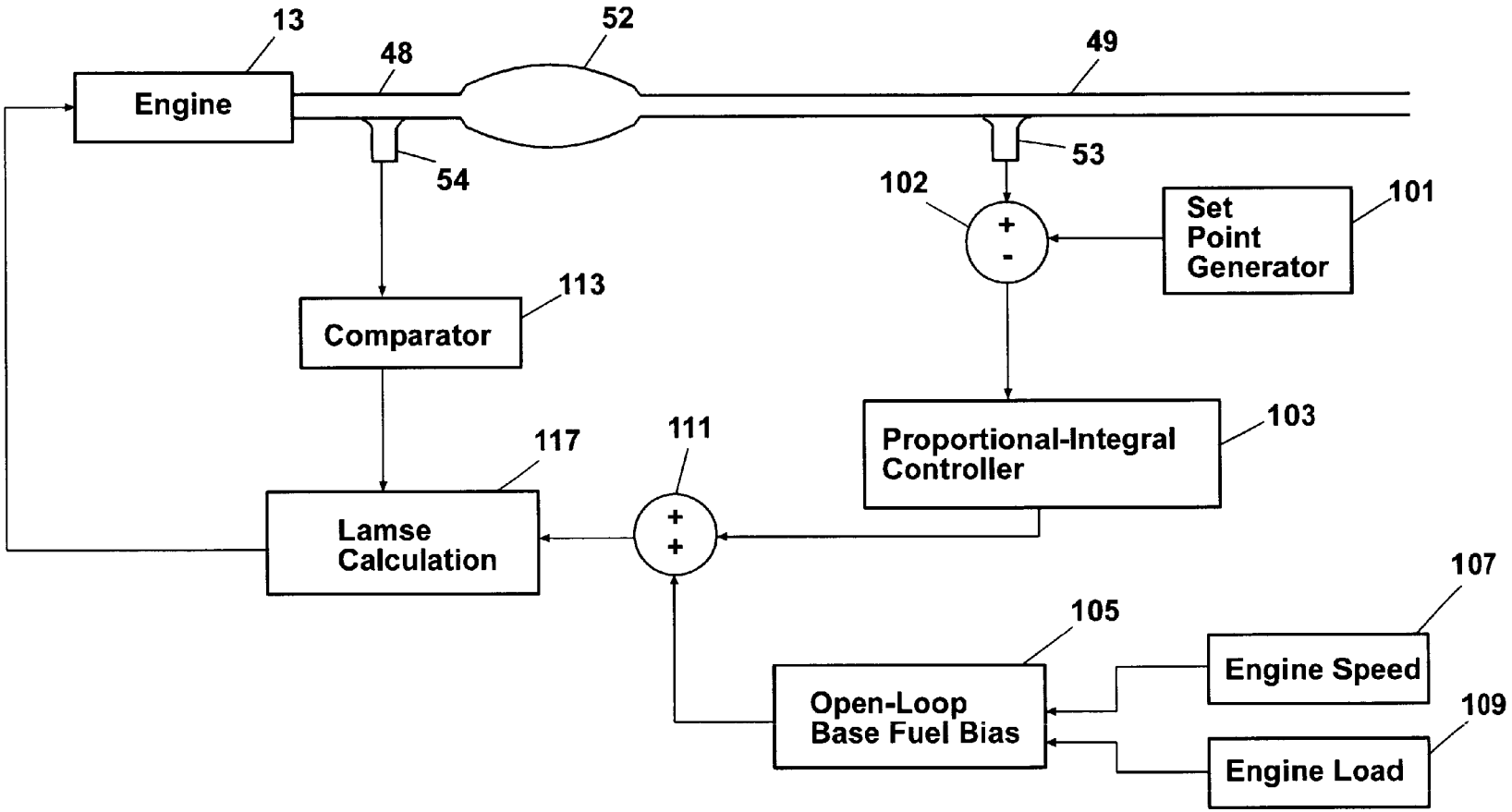
FIG. 2 functionally illustrates a preferred embodiment of the invention.

Referring now to FIG. 2, a preferred system and method for controlling the engine air/fuel ratio is schematically illustrated, with like components in FIGS. 1 and 2 having identical reference numerals. Specifically, engine 13 is coupled to catalyst 52 through exhaust manifold 48. Pre-catalyst oxygen sensor 54 and post-catalyst oxygen sensor 53 provide output signals, which are used by the engine controller 15 (in FIG. 1) to control the engine air/fuel ratio. Oxygen sensors 53 and 54 provide a continuous stream of discrete output signals to the controller 15 over time.

Each time a new engine air/fuel ratio is to be determined by the controller 15, the output signals from each of the two oxygen sensors 53 and 54 are examined. In particular, a comparator 102 compares the output signal generated by post-catalyst oxygen sensor 53 to a set point reference value. The set point reference value is generated by a set point generator 101, the operation of which is explained in detail below.

The result of the comparison between the set point reference value and the output of the post-catalyst oxygen sensor 53 is referred to as a post-catalyst error value. The post-catalyst error value is indicative of whether the exhaust gas in the tail pipe 49 has a relatively high or low concentration of oxygen, i.e., whether the downstream air/fuel ratio is lean or rich of stoichiometry. The post-catalyst error value is used by a proportional-integral controller 103 to calculate a fuel bias. Generally, if the post-catalyst error value indicates a relatively high oxygen concentration in the tail pipe 49, then the proportional-integral controller 103 will calculate a fuel bias that tends to cause the engine air/fuel ratio to be more rich. Conversely, if the post-catalyst error value indicates a relatively low oxygen concentration in the tail pipe 49, then the proportional-integral controller 103 will calculate a fuel bias that tends to cause the engine air/fuel ratio to be more lean.

A summer 111 combines the fuel bias value output from the proportional-integral controller 103 with an open-loop base fuel bias value 105, which is determined based on engine speed 107 and engine load 109 according to a variety of methods that are known in the art.

A comparator 113 compares an output signal from pre-catalyst oxygen sensor 54 to a pre-catalyst reference value, the result of which is referred to as a pre-catalyst error value. In a preferred embodiment, the pre-catalyst reference value is a constant value. The pre-catalyst error value is indicative of whether the air/fuel ratio in the exhaust manifold 48 is relatively rich or lean. The pre-catalyst error value is used with the output of summer 111 to calculate a desired engine air/fuel ratio, and thus a desired amount of fuel to inject into the engine cylinders (LAMSE). The LAMSE value is calculated in block 117 of FIG. 2. The controller 15 uses the LAMSE value to control the fuel injectors 18 (FIG. 1) to adjust the amount of fuel provided to the engine 13. Certain aspects of the above-described portion of the invention are described in more detail in U.S. Pat. No. 5,282,360 to Hamburg et al. and U.S. Pat. No. 5,492,106 to Sharma, et al., and the contents of both are hereby incorporated by reference.

Now, the set point generator 101 will be described in more detail. As indicated above, the set point generator 101 generates a set point reference value, which can be done according to various methodologies. A first preferred set point generator and methodology includes establishing a pre-determined average set point. The average set point is a constant value that is empirically-determined prior to the manufacture of the vehicle to achieve optimal vehicle emission control. For example, in a preferred embodiment of the invention, the output signal provided by post-catalyst oxygen sensor 53 is an output voltage between 0.0 and 1.0 volts, and the average set point reference value is 0.45 volts. An output voltage above 0.45 volts indicates a lean condition in the tail pipe, and an output voltage below 0.45 volts indicates a rich condition in the tail pipe.

Figure 3A:
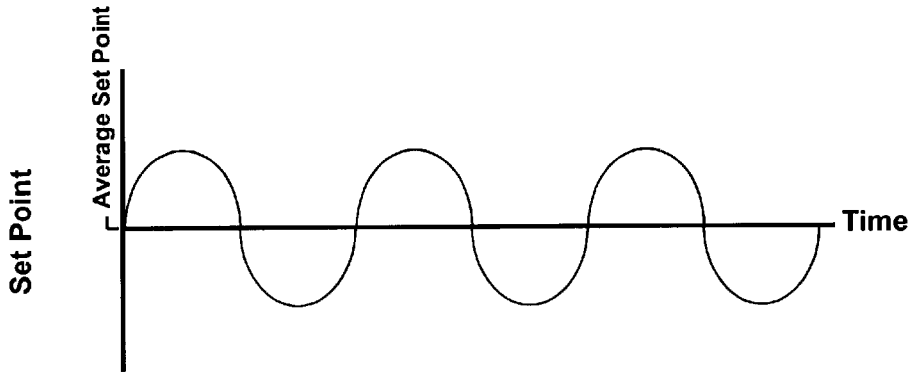
FIG. 3A illustrates a first preferred set point waveform.
Figure 3B:
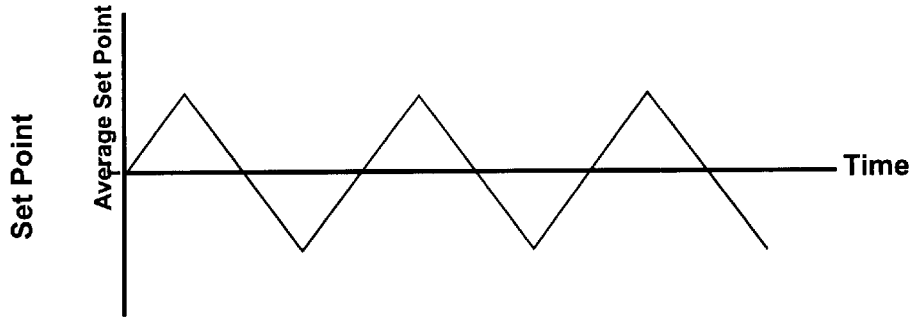
FIG. 3B illustrates a second preferred set point waveform.
Figure 3C:
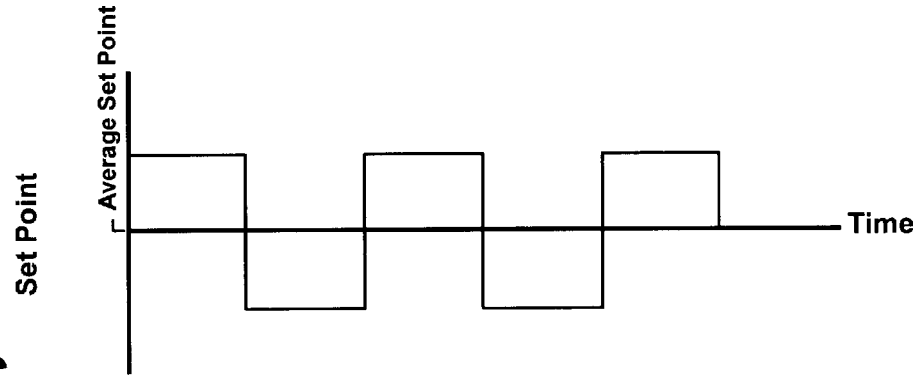
FIG. 3C illustrates a third preferred set point waveform.

The set point generator 101 generates a set point waveform that oscillates around the average set point over time. In this sense, the set point waveform varies t h e set point reference value based on time. The set point waveform can take various shapes, such as a sine, triangle, or square, for example. Three different possible set point functions are shown in FIGS. 3A–3B, though various different periodic set point waveforms can be used in accordance with this invention. Regardless of the specific shape, the set point waveform is generated around the average set point. The amplitude and frequency of the set point waveform may be predetermined, may be randomly determined by the controller 15 during vehicle operation, or may be determined based on various engine operating parameters, such as the engine speed, engine load, and/or engine air mass. If determined based on engine operating parameters, the desired amplitude and frequency of the set point waveform are preferably read from a look-up table of predetermined amplitude and frequency values, all of which are empirically-determined. The use of the set point waveform allows the output signal from the post-catalyst oxygen sensor 53 to be compared against a varying set point reference value over time, while maintaining a constant average set point reference value over that same time period. The result is that oxygen storage sites in the catalyst 52 are periodically refreshed, which facilitates higher system efficiencies in reducing undesirable vehicle emissions.

A second preferred embodiment of the set point generator is identical to the first preferred embodiment, except that the average set point is not a constant value. Rather, the average set point is variable based on the speed and/or load of the engine. Preferably, different average set points are read from a look-up table, using the engine speed and/or engine load (or parameters indicative of engine speed and/or load) as indices into the table. The average set points that make up the look-up table are predetermined to optimize the reduction of engine emissions. In this second preferred embodiment of the invention, the controller 15 determines the average set point reference value first (based on engine speed and/or load), and then generates a set point reference value waveform around the average set point reference value. In essence, one difference between the first preferred embodiment and the second preferred embodiment is that the set point waveform is offset (i.e., shifted up or down) from time to time as the engine speed and/or load changes. As with the first preferred embodiment of the set point generator, the result of generating a set point waveform facilities better vehicle emission control, particularly during extended periods of constant engine speed and/or load.

While the invention has been described above as used in connection with a known air/fuel control strategy that attempts to limit undesirable vehicle exhaust emissions by controlling the engine air/fuel ratio around stoichiometry, the invention may also be used in connection with various other air/fuel control strategies. For example, certain air/fuel control strategies attempt to limit undesirable vehicle exhaust emissions by adjusting the engine air/fuel ratio to maintain a certain target volume of oxygen in the catalyst 52. In these systems, the LAMSE value is similarly calculated in part based on an error value, which is derived from comparing the output of an exhaust gas oxygen sensor with a set point reference value. In these so-called oxygen state/space systems, according to the present invention, the set point reference value may be derived from a time-based waveform calculated as described above. Indeed, the present invention may be used in connection with a wide variety of systems that control the engine air/fuel ratio based on, at least in part, feedback signals from an exhaust gas oxygen sensor.

Preferred embodiments of the present invention have been disclosed. A person of ordinary skill in the art would realize, however, that certain modifications would come within the teachings of this invention. Therefore, the following claims should be studied to determine the true scope and content of the invention.

What is claimed is:

1. A method of adjusting an amount of fuel provided to an internal combustion engine, comprising:

generating an output signal from an exhaust gas oxygen sensor positioned in an exhaust stream from the engine;

comparing said output signal to a set point reference value that varies based on time, wherein said set point reference value is derived from a waveform having a frequency, said frequency being randomly-determined during operation of the engine; and adjusting the amount of fuel provided to the engine based on said comparison.

2. The method of claim 1, wherein said oxygen sensor is positioned downstream of an emission control device.

3. The method of claim 1, wherein said waveform is selected from the following: sine waveform, triangle waveform, and square waveform.

4. The method of claim 1, wherein said set point reference value oscillates around an average set point, and said average set point is a pre-determined constant value.

5. The method of claim 1, wherein said set point reference value oscillates around an average set point, and said average set point is determined based on at least one engine operating parameter.

6. The method of claim 5, wherein said engine operating parameter is indicative of one of the following: engine speed, engine load, engine air mass.

7. The method of claim 1, wherein said amount of fuel provided to the engine is adjusted to maintain an engine air/fuel ratio near stoichiometry.

8. The method of claim 1, wherein said amount of fuel provided to the engine is adjusted to maintain a certain amount of oxygen in the emission control device.

9. A system for adjusting an amount of fuel provided to an internal combustion engine, comprising:

an emission control device coupled to the engine;

an exhaust gas oxygen sensor positioned in an exhaust stream from the engine, said exhaust gas oxygen sensor generating an output signal;

an electronic controller for comparing said output signal to a set point reference value that varies based on time, wherein said set point reference value is derived from a waveform having a frequency, said frequency being randomly-determined during operation of the engine, and for adjusting the amount of fuel provided to the engine based on said comparison.

10. The system of claim 9, wherein said exhaust gas oxygen sensor is positioned downstream of said emission control device.

11. The system of claim 9, wherein said controller selects said waveform from the following: sine waveform, triangle waveform, and square waveform.

12. The system of claim 9, wherein said set point reference value oscillates around an average set point, and said average set point is a pre-determined constant value.

13. The system of claim 9, wherein said set point reference value varies around an average set point, and said average set point is determined based on at least one engine operating parameter.

14. The system of claim 13, wherein said engine operating parameter is indicative of one of the following: engine speed, engine load, engine air mass.

15. The system of claim 9, wherein said controller adjusts said amount of fuel provided to the engine to maintain an engine air/fuel ratio near stoichiometry.

16. The system of claim 9, wherein said controller adjusts said amount of fuel provided to the engine to maintain a certain amount of oxygen in the emission control device.

17. A method of controlling an amount of fuel provided to an internal combustion engine, comprising:

generating a first output signal from an exhaust gas oxygen sensor positioned downstream of an emission control device;

generating a second output signal from an exhaust gas oxygen sensor positioned upstream of said emission control device;

calculating a fuel bias value based on said second output signal;

comparing said first output signal to a set point reference value that is derived from a set point waveform that oscillates about an average set point;

adjusting said fuel bias value based on said comparison; and controlling the amount of fuel provided to the engine based on said adjusted fuel bias value.

18. The method of claim 17, wherein said average set point is a pre-determined constant value.

19. The method of claim 17, wherein said average set point is determined based on at least one engine operating parameter.

* * * * *